US006400332B1

(12) United States Patent
Tsai et al.

(10) Patent No.: US 6,400,332 B1
(45) Date of Patent: Jun. 4, 2002

(54) PCB DIPOLE ANTENNA

(75) Inventors: Szu-Nan Tsai; Hsiang-Hui Shen; Hsin Kuo Dai; Kun Te Cheng; Hsien-Chu Lin; Chieh-Chao Yu; Chih-Kai Huang, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/755,397

(22) Filed: Jan. 3, 2001

(51) Int. Cl.[7] ..... H01Q 9/28
(52) U.S. Cl. ..... 343/795; 343/700 MS
(58) Field of Search ..... 343/795, 700 MS, 343/702, 793, 797

(56) References Cited

U.S. PATENT DOCUMENTS 5,293,175 A * 3/1994 Hemmie et al. ..... 343/795
5,691,734 A * 11/1997 Davies ..... 343/795
6,281,849 B1 * 8/2001 Brachat ..... 343/700 MS

* cited by examiner

*Primary Examiner*—Don Wong
*Assistant Examiner*—Hoang Nguyen
(74) *Attorney, Agent, or Firm*—Wei Te Chung

(57) ABSTRACT

A PCB dipole antenna (1) for placing in an electronic device includes a first dipole antenna element (2), a second dipole antenna element (3), a printed circuit board (4), a first feeder apparatus (71) and a second feeder apparatus (72). The first dipole antenna element is perpendicular to the second dipole antenna element. Each first and second dipole antenna element includes two dipole cells respectively disposed on opposite surfaces of the printed circuit board. Each first and second dipole antenna element is fed through the first and second feeder apparatuses respectively. Switching of dual polarized radiation of the PCB dipole antenna is carried out under the control of an external device. This makes full use of two of the three radiation planes, and provides maximum diversity radiation efficiency.

21 Claims, 4 Drawing Sheets

| 1:Mkr (MHz) | | | 2: Mkr (MHz) dB |
|---|---|---|---|
| A: | 2400.0000 | 1.783 | |
| B: | 2500.0000 | 1.774 | |
| C> | 2600.0000 | 1.880 | |

PCB DIPOLE ANTENNA

BACKGROUND OF THE INVENTION

1. Field of the Invention

The present invention relates to a PCB dipole antenna, and more particularly to a dual-fed PCB dipole antenna used in an electronic device for receiving and/or transmitting electromagnetic signals.

2. Related Art

In the communications field, dipole antennas have been widely used for a long time for effectively receiving and transmitting electromagnetic signals. Most electronic devices use single dipole antennas. Conventionally, a single dipole antenna has three radiation planes, namely an XY-plane, an XZ-plane and a YZ-plane. Generally, only one of these radiation planes has preferred radiation efficiency, and the other radiation planes are disregarded. Moreover, a feeding device of a conventional single dipole antenna is complex and occupies a lot of space. An antenna disclosed in U.S. Pat. No. 4,605,931 utilizes a crossover feeding system. The system comprises pairs of a first feeder apparatus and a second feeder apparatus, one feeder apparatus crossing over the other. Each pair of the crossed first and second feeder apparatuses has a first port and a second port for transmitting a first signal therebetween, and a third port and a fourth port for transmitting a second signal therebetween. The system reduces interaction between signals, and eliminates back feeding of signals. However, the system is too complex to be practically implemented.

Taiwan Patent Application No. 87112281 discloses a circular polarized microstrip antenna that has a short adjustable metal microchip on an edge of a fixed metal microchip. A feed point of the microstrip antenna is on the short adjustable metal microchip or a cross-line thereof which is oriented at 45°. The metal microchip is installed on a grounding plane. The microstrip antenna has preferred radiation efficiency in the XZ-plane and the YZ-plane. However, the microstrip antenna is also very complex. It requires a large space, and cannot be easily integrated into communications equipment.

Other antennas are disclosed in U.S. Pats. Nos. 4,069,483 and 6,091,366. They all utilize only one of the three radiation planes to provide radiation efficiency.

SUMMARY OF THE INVENTION

An object of the present invention is to provide a PCB dipole antenna for placing in an electronic device and having a switch mechanism of dual polarized radiation for making full use of two of the three radiation planes, thereby providing maximum diversity radiation efficiency.

Another object of the present invention is to provide a method of manufacturing an antenna having a switch mechanism of dual polarized radiation for making full use of two of the three radiation planes, thereby providing maximum diversity radiation efficiency.

A further object of the present invention is to provide a PCB dipole antenna which is small and simple in structure, and which reduces manufacturing time and costs.

To achieve the above objects, a PCB dipole antenna in accordance with a preferred embodiment of the present invention for placing in an electronic device includes a first dipole antenna element, a second dipole antenna element, a printed circuit board, a first feeder apparatus and a second feeder apparatus. The first dipole antenna element is perpendicular to the second dipole antenna element. Each of the first and second dipole antenna elements includes two dipole cells respectively disposed on opposite surfaces of the printed circuit board. The first and second dipole antenna elements are fed through the first and second feeder apparatuses respectively. Switching of dual polarized radiation of the PCB dipole antenna is carried out under the control of an external device. This makes full use of two of three radiation planes, and provides maximum diversity radiation efficiency.

These and additional objects, features and advantages of the present invention will become apparent after reading the following detailed description of a preferred embodiment of the invention taken in conjunction with the appended drawings.

DETAILED DESCRIPTION OF THE INVENTION

Figure 1:
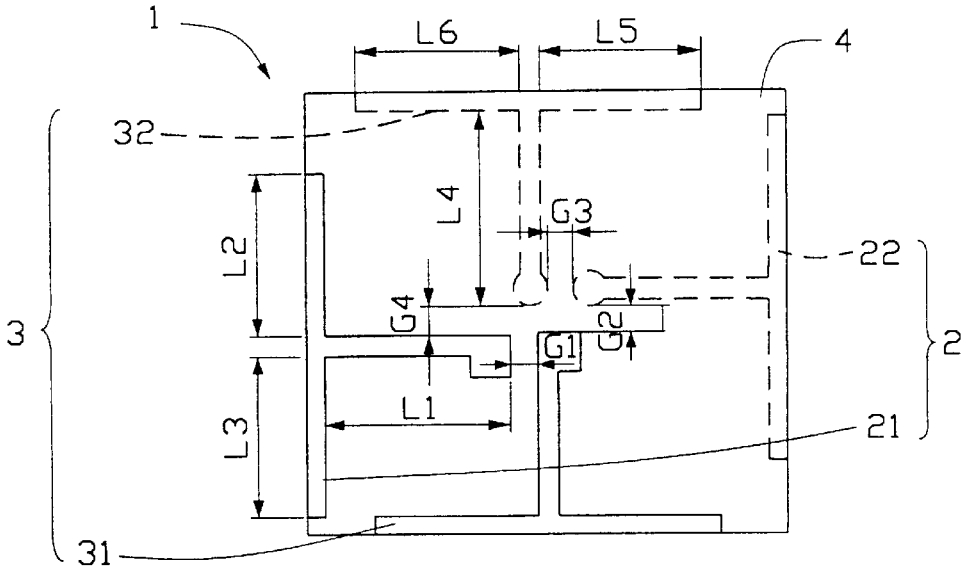
FIG. 1 is a plan view of a PCB dipole antenna in accordance with a preferred embodiment of the present invention.
Figure 2:
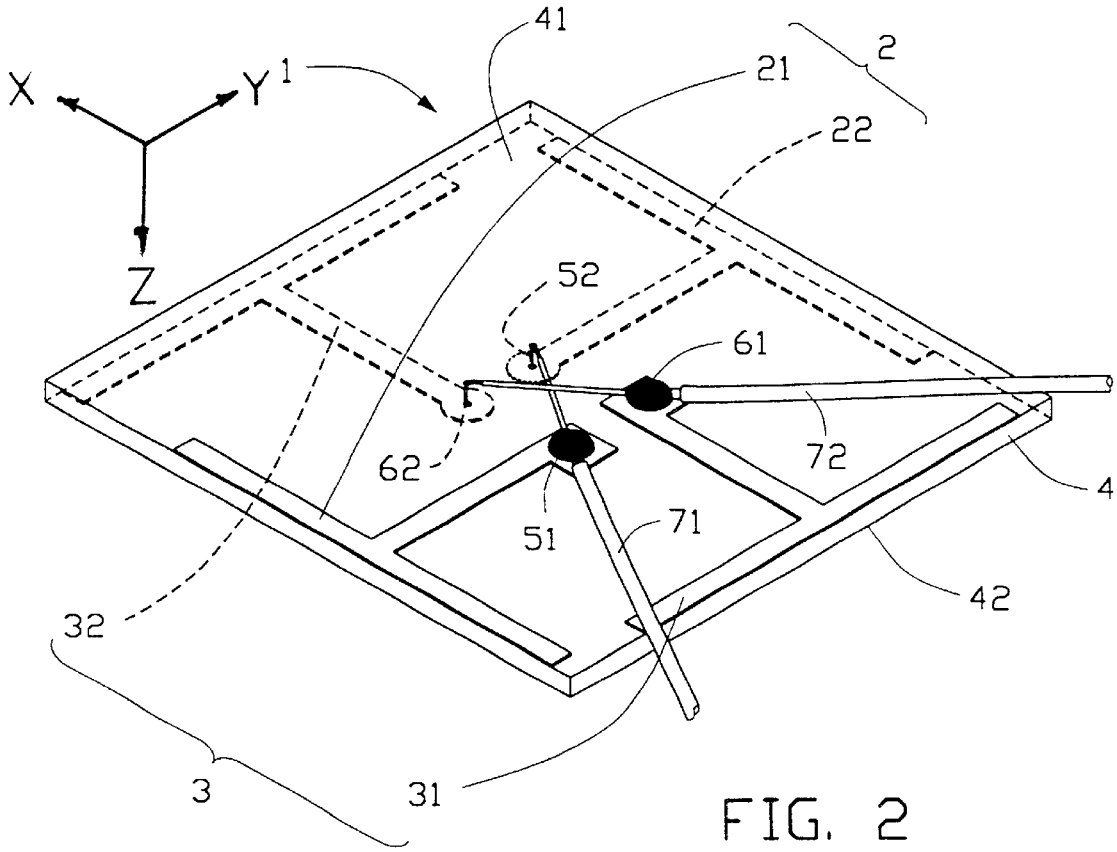
FIG. 2 is a perspective view of the PCB dipole antenna of FIG. 1.

Referring to FIGS. 1 and 2, a PCB dipole antenna 1 in accordance with a preferred embodiment of the present invention comprises a first dipole antenna element 2, a second dipole antenna element 3, a printed circuit board 4, a first feeder apparatus 71 and a second feeder apparatus 72.

The first dipole antenna element 2 includes a first dipole cell 21 and a second dipole cell 22, and the second dipole antenna element 3 includes a third dipole cell 31 and a fourth dipole cell 32. The first and the third dipole cells 21, 31 are disposed on a first surface 41 of the printed circuit board 4, and perpendicular to each other. The second and the fourth dipole cells 22, 32 are disposed on a second surface 42 of the printed circuit board 4 which is opposite to the first surface 41, and perpendicular to each other. In order to save surface space of the printed circuit board 4, the first, second, third and fourth dipole cells 21, 22, 31, 32 are all T-shaped. The first dipole antenna element 2 is perpendicular to the second dipole antenna element 3, to obtain dual polarized radiation for the PCB dipole antenna 1.

In the preferred embodiment of the invention, the first and second feeder apparatuses 71, 72 are coaxial feeders, each including a ground line (not labeled) and a signal line (not labeled). The first and the second feeder apparatuses 71, 72 are crossed over at a center portion of the printed circuit board 4.

First, second, third and fourth feed points 51, 52, 61 and 62 are located in a central portion of the printed circuit board 4, at ends of the first, second, third and fourth dipole cells 21, 22, 31, 32 respectively. One of the signal line and the ground line of the first feeder apparatus 71 is connected with the first feed point 51 by welding, and the other line is connected with the second feed point 52 by welding at an end of the first feeder apparatus 71. One of the signal line and the ground line of the second feeder apparatus 72 is connected with the third feed point 61 by welding, and the other line is connected with the fourth feed point 62 by welding at an end of the second feeder apparatus 72. The first and second dipole antenna elements 2, 3 are respectively fed through the first and second feeder apparatuses 71, 72. The other ends of the first and second feeder apparatuses 71, 72 are connected with an external device. Switching of dual polarized radiation of the PCB dipole antenna 1 is carried out under the control of the external device, thereby making full use of two of the three radiation planes to provide maximum diversity radiation efficiency.

In an alternative embodiment of the present invention, the first, second, third and fourth feed points 51, 52, 61 and 62 are moved from a central portion of the printed circuit board 4 to peripheries of the first and second surfaces 41, 42 of the printed circuit board 4. This reduces the influence that wiring paths of the first and second feeder apparatuses 71, 72 welded on the feed points have on the characteristics of the PCB dipole antenna 1.

L1, L2 and L3 shown in FIG. 1 respectively designate lengths of three sections of the first dipole cell 21, and of the third dipole cell 31. L4, L5 and L6 respectively designate lengths of three sections of the second dipole cell 22, and of the fourth dipole cell 32. G1 designates a distance between the feed points 51 and 61. G2 designates a distance between the feed points 61 and 52. G3 designates a distance between the feed points 52 and 62. G4 designates a distance between the feed points 62 and 51. The structural dimensions of the preferred embodiment of the invention are as follows:

L1=L4

L2=L3=L5=L6

G1=G2=G3=G4

These dimensions enable the PCB dipole antenna 1 to be compact, thereby saving space in accompanying communications equipment.

Figure 3:
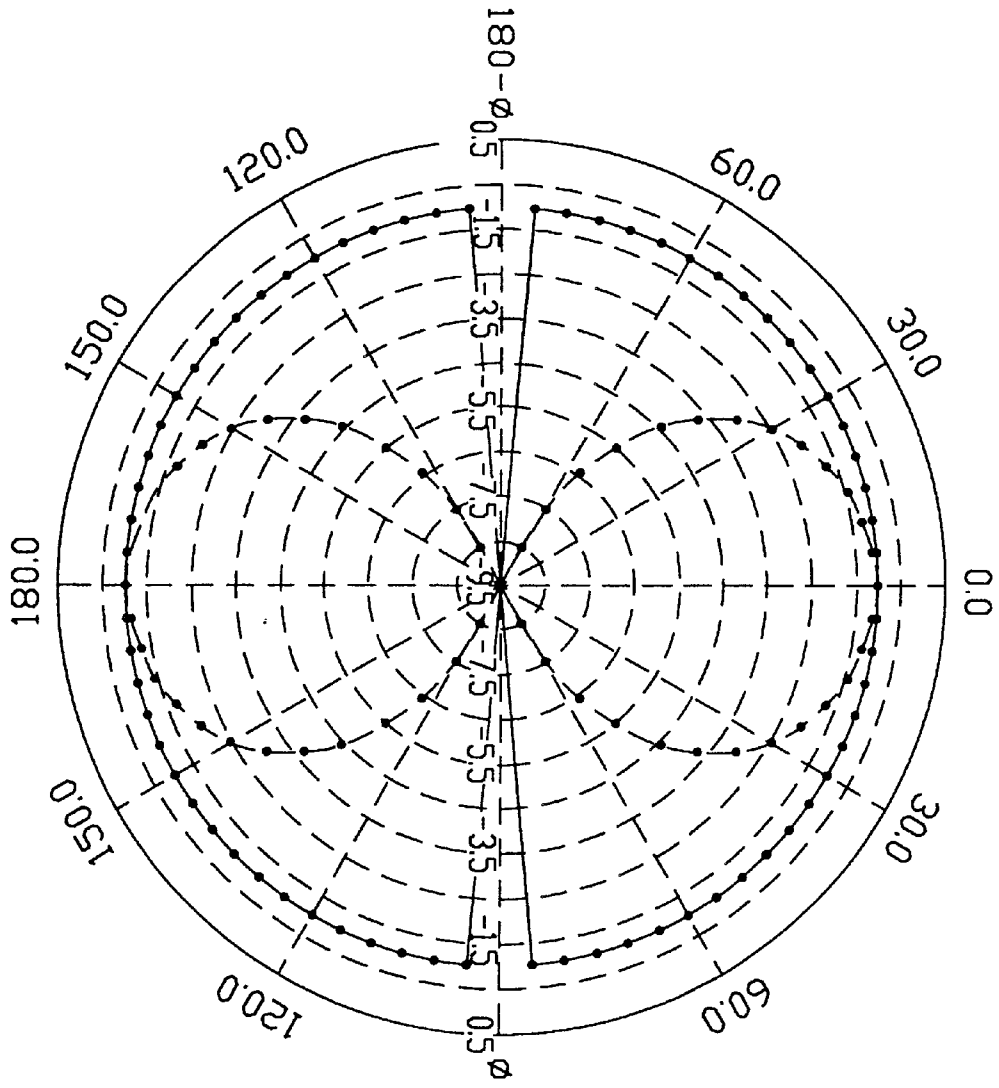
FIG. 3 shows a radiation pattern in an XZ-plane of the PCB dipole antenna of FIG. 1.
Figure 4:
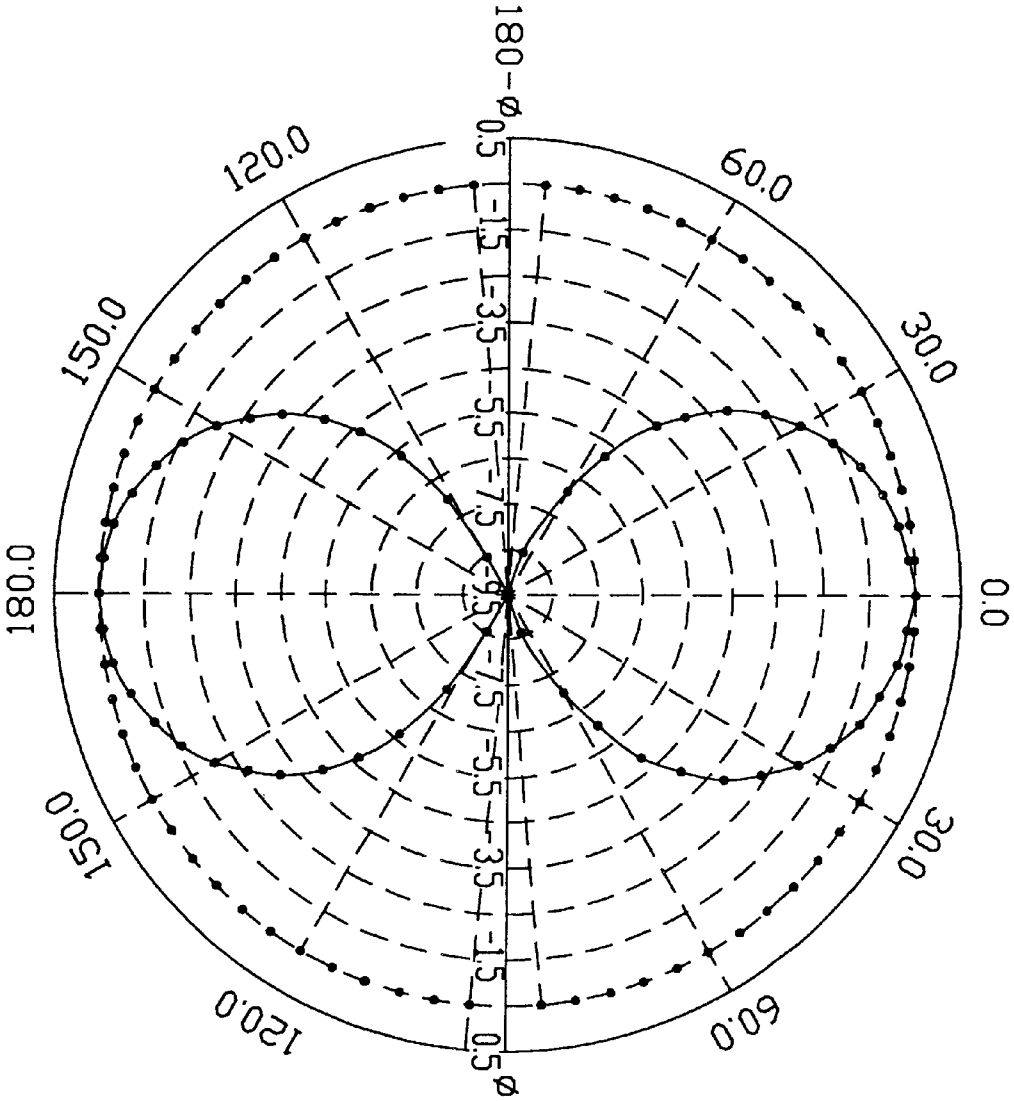
FIG. 4 shows a radiation pattern in a YZ-plane of the PCB dipole antenna of FIG. 1.

FIG. 3 shows an antenna radiation pattern in the XZ-plane, and FIG. 4 shows an antenna radiation pattern in the YZ-plane. One-half (½) peak gains of the dipole antenna in the XZ-plane and the YZ-plane can respectively reach −1.0 and −0.5 dB. This assures maximum diversity radiation efficiency of the PCB dipole antenna 1.

Voltage Standing Wave Ratio (VSWR) is a standard criterion used in measuring antenna characteristics in a certain frequency range. In general, a VSWR greater than 1 is considered reasonable in the communications field. In addition, prevailing industry standards of antenna design dictate that for a given frequency range, a VSWR less than 2.0 is required for effective operation.

Figure 5:
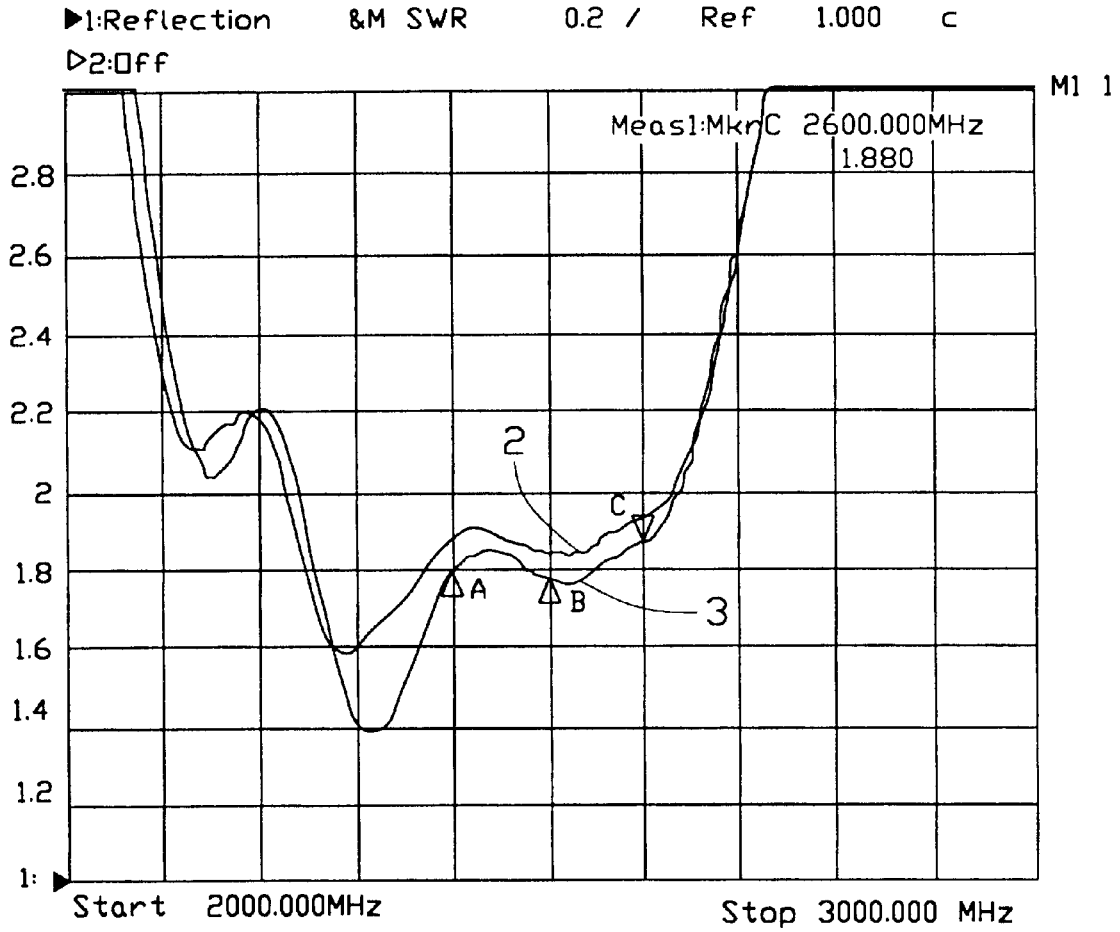
FIG. 5 is a graph of experimental results for the PCB dipole antenna of FIG. 1.

FIG. 5 is a graph of experimental results for the PCB dipole antenna 1, showing VSWR varying with frequency. The results show that the VSWR of each of the first and second dipole antenna elements 2, 3 is less than 2.0 in the frequency range of 2.4–2.5 GHz. These results comply with industry-standard antenna design specifications.

The PCB dipole antenna 1 utilizes the switch mechanism of dual polarized radiation to make full use of two of the three radiation planes, thereby providing maximum diversity radiation efficiency in compliance with industry-standard antenna design specifications.

In summary, the present invention overcomes the problems of conventional technology, is simple in structure, and achieves higher efficiency for receiving and/or transmitting electromagnetic signals. While the present invention has been described with reference to a specific embodiment thereof, the description is illustrative and is not to be construed as limiting the invention. Various modifications to the present invention may be made to the preferred embodiments by those skilled in the art without departing from the true spirit and scope of the invention as defined by the appended claims.

We claim:

1. A PCB dipole antenna for receiving and/or transmitting electromagnetic signals, comprising:

a printed circuit board;

a first dipole antenna element and a second dipole antenna element, each element comprising two dipole cells respectively disposed on a first surface and an opposite second surface of the printed circuit board; and a first feeder apparatus and a second feeder apparatus through which the first and the second dipole antenna elements are fed, respectively.

2. The PCB dipole antenna as claimed in claim 1, wherein the first dipole antenna element is perpendicular to the second dipole antenna element.

3. The PCB dipole antenna as claimed in claim 1, wherein each dipole cell is T-shaped.

4. The PCB dipole antenna as claimed in claim 1, wherein each dipole cell has a feed point.

5. The PCB dipole antenna as claimed in claim 4, wherein each feed point is located in a central portion of the printed circuit board.

6. The PCB dipole antenna as claimed in claim 4, wherein each feed point is located on a periphery of the same surface of the printed circuit board as its corresponding dipole cell.

7. The PCB dipole antenna as claimed in claim 1, wherein the first and second feeder apparatuses are coaxial feeders each comprising a signal line and a ground line.

8. The PCB dipole antenna as claimed in claim 7, wherein each dipole cell has a feed point, and each dipole cell is connected with one end of one of the signal line and the ground line of its corresponding feeder apparatus at its corresponding feed point.

9. The PCB dipole antenna as claimed in claim 8, the first feeder apparatus and the second feeder apparatus are crossed over at a central portion of the printed circuit board.

10. The PCB dipole antenna as claimed in claim 8, wherein the other end of each connected signal line and each connected ground line of the corresponding feeder apparatuses are connected with an external device.

11. A method for manufacturing a PCB dipole antenna, comprising the steps of:

(1) providing a printed circuit board;

(2) providing at least two dipole antenna elements, each element comprising two dipole cells respectively disposed on opposite surfaces of the printed circuit board;

(3) providing at least two feeder apparatuses;

(4) connecting one end of each feeder apparatus with at least one of the dipole antenna elements; and (5) connecting the other end of the each feeder apparatus with an external device, to achieve switching of dual polarized radiation of the antenna under the control of the external device.

12. The method as claimed in claim 11, wherein two of the dipole antenna elements are arranged to be perpendicular to each other, and any other dipole antenna elements are arranged to be respectively and alternately parallel to each of the said two dipole antenna elements.

13. The method as claimed in claim 11, wherein the dipole cells of the dipole antenna elements are each designed to be T-shaped.

14. A PCB dipole antenna for receiving and/or transmitting electromagnetic signals, comprising:

a printed circuit board;

at least two dipole antenna elements, each element comprising two dipole cells respectively disposed on opposite surfaces of the printed circuit board; and at least two feeder apparatuses through which the dipole antenna elements are fed.

15. The PCB dipole antenna as claimed in claim 14, wherein two of the dipole antenna elements are perpendicular to each other, and any other dipole antenna elements are respectively and alternately parallel to each of the said two dipole antenna elements.

16. The PCB dipole antenna as claimed in claim 15, wherein one end of each feeder apparatus is connected with at least one of the dipole antenna elements.

17. The PCB dipole antenna as claimed in claim 16, wherein the other end of each feeder apparatus is connected with an external device.

18. The PCB dipole antenna as claimed in claim 14, wherein the dipole cells of the dipole antenna elements are each T-shaped.

19. A PCB dipole antenna comprising:

a printed circuit board;

first and second dipole antenna elements formed on the printed circuit board, said first dipole element defining first and second dipole cells opposite to each other, and said second dipole element defining third and fourth dipole cells opposite to each other, said first, second, third and fourth dipole cells generally pointing respectively two pairs of opposite directions of coordinate axes of the printed circuit board and electrically isolated from one another;

first and second feeder apparatuses respectively mechanically and electrically connected to the first and the second dipole antenna elements with a cross configuration thereof.

20. The antenna as claimed in claim 19, wherein said first feeder apparatus includes at least one signal line and one ground line respectively soldered to the corresponding first and second dipole cells, and said second feeder apparatus includes at least one signal and one ground line respectively soldered to the corresponding third and fourth dipole cells.

21. A PCB dipole antenna comprising:

a printed circuit board;

first and second dipole antenna elements formed on the printed circuit board, said first dipole element defining first and second dipole cells, and said second dipole element defining third and fourth dipole cells, said first, second, third and fourth dipole cells generally disposed on X-Y plane of a rectangular coordinate system in which the printed circuit board positioned;

first and second feeder apparatuses respectively mechanically and electrically connected to the first and the second dipole antenna elements; wherein said first and second dipole antenna elements respectively dominate radiation in X-Z and Y-Z planes of said rectangular coordinate system.

* * * * *